US008100991B2

(12) United States Patent
Sasauchi et al.

(10) Patent No.: US 8,100,991 B2
(45) Date of Patent: Jan. 24, 2012

(54) BIOMASS GASIFICATION APPARATUS

(75) Inventors: Kenichi Sasauchi, Osaka (JP); Miki Taniguchi, Osaka (JP); Takumi Kato, Osaka (JP)

(73) Assignee: Chugai Ro Co., Ltd. (JP)

( * ) Notice: Subject to any disclaimer, the term of this patent is extended or adjusted under 35 U.S.C. 154(b) by 888 days.

(21) Appl. No.: 12/097,905

(22) PCT Filed: Nov. 16, 2006

(86) PCT No.: PCT/JP2006/322816

§ 371 (c)(1),
(2), (4) Date: Jun. 18, 2008

(87) PCT Pub. No.: WO2007/077685

PCT Pub. Date: Jul. 12, 2007

(65) Prior Publication Data

US 2009/0260286 A1 Oct. 22, 2009

(30) Foreign Application Priority Data

Dec. 28, 2005 (JP) ..... 2005-378083

(51) Int. Cl.

| | |
|---|---|
| ***B01J 7/00*** | (2006.01) |
| ***H01M 8/06*** | (2006.01) |
| ***C01B 3/36*** | (2006.01) |
| ***C01B 6/24*** | (2006.01) |
| ***C01B 3/02*** | (2006.01) |
| ***C10J 3/46*** | (2006.01) |

(52) U.S. Cl. ..... 48/61; 48/197 R; 423/644; 423/648.1

(58) Field of Classification Search ..... 48/61–210; 423/644–658

See application file for complete search history.

(56) References Cited

U.S. PATENT DOCUMENTS

| | | | | |
|---|---|---|---|---|
| 4,496,313 | A * | 1/1985 | Quittkat et al. | 432/14 |
| 5,063,732 | A * | 11/1991 | Calderon | 60/781 |
| 5,136,808 | A * | 8/1992 | Calderon | 48/62 R |
| 6,409,790 | B1 * | 6/2002 | Calderon et al. | 75/10.12 |
| 6,911,058 | B2 * | 6/2005 | Calderon et al. | 48/197 R |
| 2005/0247553 | A1 | 11/2005 | Ichikawa et al. | |

FOREIGN PATENT DOCUMENTS

| | | | |
|---|---|---|---|
| EP | 1 580 253 | A1 | 9/2005 |
| JP | 2004-250574 | A | 9/2004 |
| JP | 2005-112956 | A | 4/2005 |
| JP | 2005-247992 | A | 9/2005 |
| JP | 2005-272530 | A | 10/2005 |

* cited by examiner

*Primary Examiner* — Matthew Merkling
(74) *Attorney, Agent, or Firm* — DLA Piper LLP (US)

(57) ABSTRACT

A compact biomass gasification apparatus is capable of gasifying a wide variety of biomass materials, without regard to their size and/or the water content of those materials, and also capable of substantially removing the tar component generated in a gasification process.

A biomass gasification apparatus primarily includes an externally heated rotary kiln-type thermal cracking unit (2) indirectly heating and thermally cracking a biomass material to generate a tar-containing pyrolysis gas and char from the biomass material, and a gasification unit (3) receiving the tar-containing pyrolysis gas and char from the thermal cracking unit (2) and thermally cracking the tar component in the pyrolysis gas and gasifying the char by an oxidation gas being introduced therein.

1 Claim, 2 Drawing Sheets

BIOMASS GASIFICATION APPARATUS

RELATED APPLICATIONS

This is a §371 of International Application No. PCT/JP2006/322816, with an international filing date of Nov. 16, 2006 (WO 2007/077685 A1, published Jul. 12, 2007), which is based on Japanese Patent Application No. 2005-378083, filed Dec. 28, 2005.

TECHNICAL FIELD

This disclosure relates to a compactly structured biomass gasification apparatus capable of gasifying a wide variety of biomass substances, regardless of their size and/or water content, and of removing a high percentage of the tar generated in a gasification process.

BACKGROUND

Japanese Unexamined Patent Publication Nos. 2005-247992 and 2004-250574 describe gasification systems capable of generating a pyrolysis gas from biomass materials. Japanese Unexamined Patent Publication No. 2005-247992 describes a "Biomass Gasification System and Operating Method Therefor" wherein a gas reforming tower is connected to a supply system which delivers fuel gas generated from biomass in a gasifire, the gas reforming tower having the purpose of raising the temperature of the fuel gas to a process temperature at which the tar component in the fuel gas may be thermally cracked. A gas cooling tower is installed downstream from the gas reforming tower as means of cooling the fuel gas. Moreover, the remaining char generated in the gasifire is used as a fuel for a thermal airflow generator which generates thermal energy utilized by the gasifire.

Japanese Unexamined Patent Publication No. 2004-250574 discloses a "Method for Modeling Fixed Bed Gasifier for Biomass" which describes a biomass gasification process utilizing a down-draft type of a fixed bed gasification furnace.

Japanese Unexamined Patent Publication No. 2004-250574 discloses a so-called downdraft furnace which has certain operational limitations requiring that the biomass materials fed into the furnace not to be a fibrous substance such as bamboo or tree bark, not to be of varying size, and not to contain excess amounts of water. This type of furnace places various restrictions on the process because it is not able to gasify biomass materials of various types, size, and water content. Moreover, a further ramification of this type of furnace is that it is difficult to control at will the gasification temperature therein.

Japanese Unexamined Patent Publication No. 2005-247992 discloses a rotary kiln which applies indirect heating to generate a pyrolysis gas from biomass. Due to the large tar component contained in the pyrolysis gas, the gas reforming tower must be installed downstream from the rotary kiln as means of removing the tar component. Moreover, the gas cooling tower must also be provided due to the 1,100° C. temperature of the pyrolysis gas exiting the gas reforming tower. The installation of these apparatuses results in a gasification system of extraordinarily large size.

It could therefore be helpful to provide a compactly structured biomass gasification apparatus capable of gasifying a wide range of biomass materials regardless of their size and/or water content, and of removing a high percentage of the tar component generated in a gasification process.

SUMMARY

We provide a biomass gasification apparatus including an externally heated rotary kiln thermal cracking unit that indirectly heats and thermally cracks a biomass material to generate a tar-containing pyrolysis gas and char from the biomass material, and a gasification unit that receives the tar-containing pyrolysis gas and char from the thermal cracking unit, and thermally cracks the tar component in the pyrolysis gas and gasifies the char by oxidation gas introduced therein.

EXPLANATION OF NUMERALS

1 biomass gasification apparatus
2 thermal cracking unit
3 gasification unit
'A' tar component thermal cracking region
'B' char gasification region
'C' reduction region

DETAILED DESCRIPTION

The biomass gasification apparatus comprises an externally heated rotary kiln-type thermal cracking unit indirectly heating and thermally cracking a biomass material to generate a tar-containing pyrolysis gas and char from the biomass material, and a gasification unit receiving the tar-containing pyrolysis gas and char from the thermal cracking unit and thermally cracking the tar component in the pyrolysis gas and gasifying the char by an oxidation gas being introduced therein.

The gasification unit preferably includes a tar component thermal cracking region in which the tar component is thermally cracked, and a char gasification region in which the char is gasified and the remaining ash discharged therefrom.

The gasification unit is preferably structured as a shaft-type furnace.

The biomass gasification apparatus is able to process biomass materials without regard to the type, size, or water content thereof, to provide an improved tar component removal function, and to be structured to compact physical dimensions.

Figure 1:
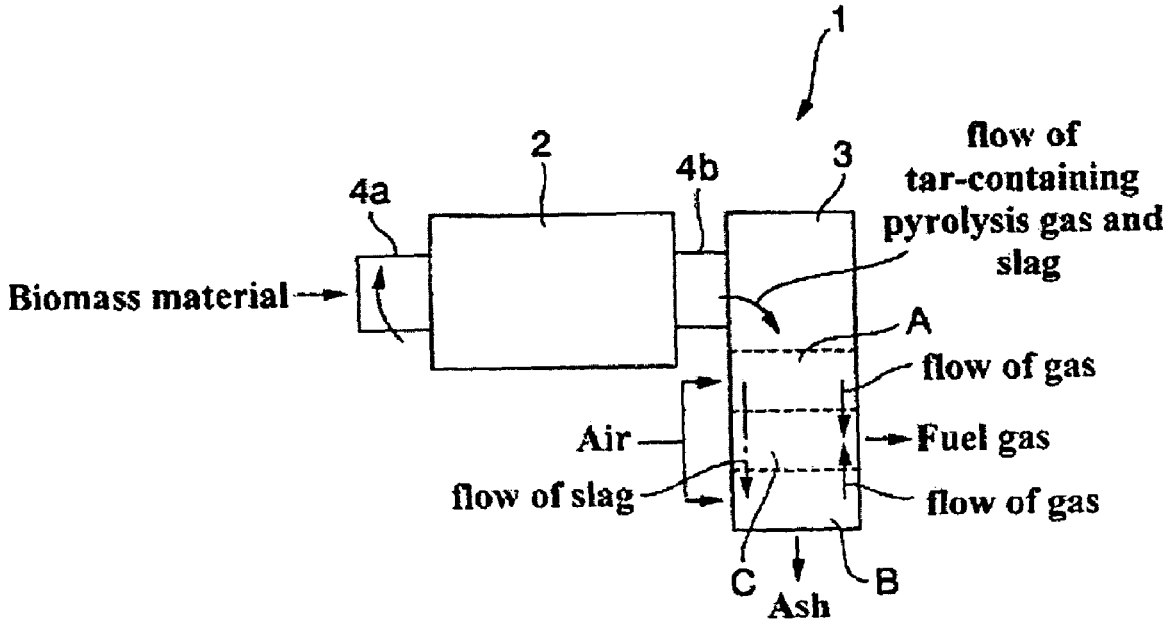
FIG. 1 is a block diagram of an example of our biomass gasification apparatus.
Figure 2:
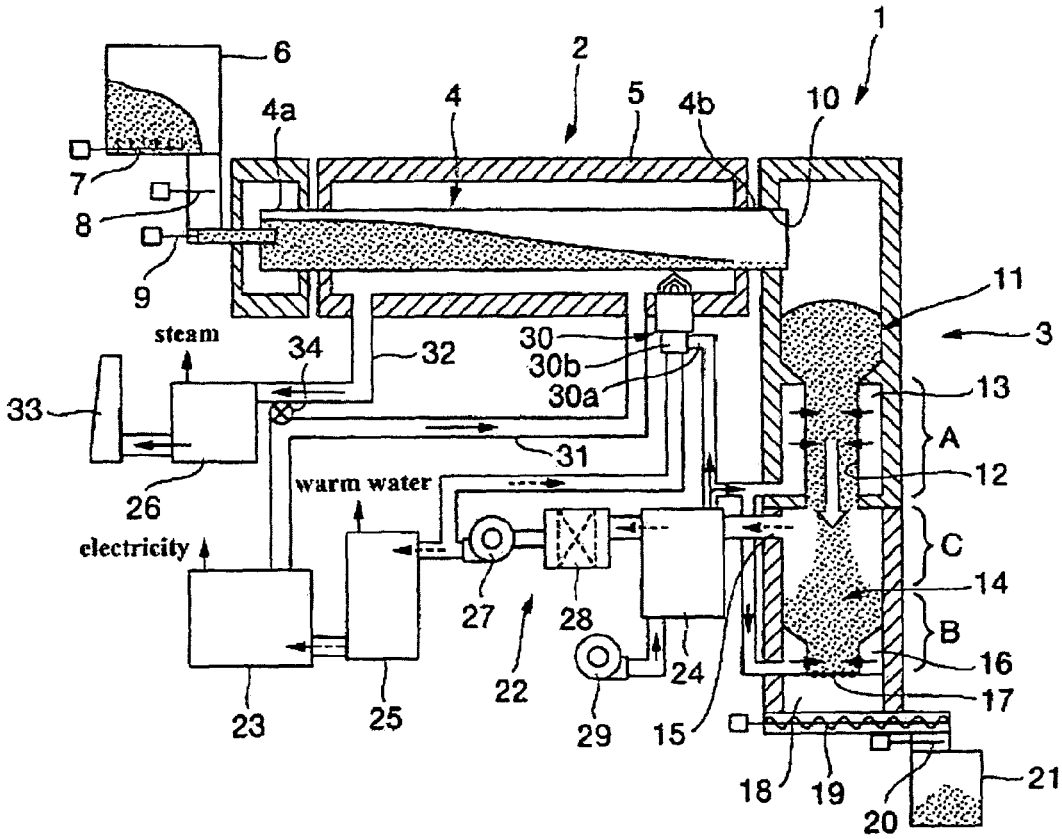
FIG. 2 is a detailed schematic drawing of an example of our biomass gasification apparatus, including a gas supply system.

The following describes a representative example of the biomass gasification apparatus with reference to the attached drawings. The biomass gasification apparatus 1, as shown in FIG. 1 and FIG. 2, includes a thermal cracking unit 2, structured in the form of an externally heated rotary kiln, which indirectly applies thermal energy to thermally crack biomass material to generate a tar-containing pyrolysis gas and char. The biomass gasification apparatus 1 also includes a gasification unit 3 to which an oxidizing gas is introduced to thermally crack the tar component and gasify the char extracted from the thermal cracking unit 2. The gasification unit 3 includes a tar component thermal cracking region 'A' where the tar component is thermally cracked, and a char gasification region 'B' where the char is gasified and remaining ash extracted. The gasification unit 3 is structured as a shaft-type furnace.

The thermal cracking unit 2 is structured as externally heated rotary kiln primarily comprising: a reaction chamber 4 structured as a horizontally disposed hollow cylinder, and a horizontally disposed hollow cylindrical chamber 5 which encloses the reaction chamber 4. The reaction chamber 4 is slightly inclined from a loading port 4*a* to an extraction port 4*b*. The reaction chamber 4 is sealed from the external environment to provide a non-oxidizing environment. A thermal medium, which is supplied to the internal region of the chamber 5, serves as a heat source through which the reaction chamber 4 is heated indirectly by the chamber 5. The biomass material held in a material hopper 6 is supplied by a feeder 7, through the operation of a damper valve 8, to a pusher 9 which transports the biomass material into the reaction chamber 4.

The biomass material is fed into the thermal cracking unit 2 through a loading port 4*a* after which it is dried and thermally cracked by the indirect application of thermal energy to generate a tar-containing pyrolysis gas and char which exit through the extraction port 4*b*.

Thermal cracking unit 2, more specifically the extraction port 4*b* of the externally heated rotary kiln, connects to the gasification unit 3. The gasification unit 3 is structured as a vertical shaft-type furnace comprising the following components, which shall be described in sequence starting from the topmost part towards the bottom part, as illustrated in FIG. 2. They are:

- an insertion port 10, connected to the extraction port 4*b* of the thermal cracking unit 2, through which the tar-containing pyrolysis gas and char are fed to the gasification unit 3;
- a 1st accumulator 11, formed as a hopper-shaped compartment beneath the insertion port 10, which temporarily stores the flowing char downwardly from the insertion port 10;
- a 1st oxidation gas supply part 13 formed as a ring-shaped cylindrical compartment beneath the 1st accumulator 11 to define inside a downflow duct 12 which is connected to the 1st accumulator 11, and introducing an oxidation gas, such as air, into the downflow duct 12;
- a 2nd accumulator 14 formed as a compartment disposed below and connected to the downflow duct 12, the 2nd accumulator 14 providing a space for temporary storage of char flowing downwardly through the downflow duct 12 from the 1st accumulator 11;
- a gas extraction port 15 formed at the top of the 2nd accumulator 14 directly below the 1st oxidation gas supply part 13, and extracting the fuel gas as a flammable component generated in the thermal cracking unit 2 and gasification unit 3;
- a 2nd oxidation gas supply part 16 structured as a ring-shaped compartment forming the lower portion of the 2nd accumulator 14 into a narrowing hopper-like shape which guides the char downwardly while allowing introduction of an oxidation gas, such as air, into the 2nd accumulator 14; and
- an ash trap 18 formed as a compartment directly beneath the 2nd accumulator 14, the ash trap 18 being connected to the 2nd accumulator 14 through a grate 17 to collect ash as the end product.

The ash remaining at the end of the process is collected within the ash trap 18 from where it is transported to ash receiver 21 through the operation of a screw feeder 19 and a damper valve 20.

The pyrolysis gas and char move from the thermal cracking unit 2 to the gasification unit 3 through the insertion port 10. As a result of the suction generated by the (subsequently described) gas supply system 22, the pyrolysis gas is drawn from the 1st accumulator 11 into the downflow duct 12, which is surrounded by the 1st oxidation gas supply part 13, from where it flows toward the gas extraction port 15 of the 2nd accumulator 14. While temporarily held in the 1st accumulator 11, the char concurrently falls from the 1st accumulator 11 into the 2nd accumulator 14 through the downflow duct 12. The char accumulated in the 2nd accumulator 14 concurrently passes through the 2nd oxidation gas supply part 16 from where it falls into the ash trap 18 through the grate 17. The tar component thermal cracking region 'A' for gasifying the tar component is the area where the oxidation gas flows through the downflow duct 12 in the periphery of the 1st oxidation gas supply part 13, and the char gasification region 'B' is the area where the oxidized gas in the 2nd accumulator 14 flows in the periphery of the 2nd oxidation gas supply part 16. The char gasification region 'B' is the area where the ash generated from the gasified char is discharged.

The biomass gasification apparatus 1 is structured to include a gas supply system 22 which is connected to the gas extraction port 15 of the gasification unit 3, and which feeds generated fuel gas to a gas engine electrical generator 23. In this example, the fuel gas is not only used as fuel to power the gas engine electrical generator 23, but may also be a heat source utilized by all devices in the apparatus requiring a thermal power source. These devices may comprise an air pre-heater 24, a heat exchanger 25 used to generate hot water, and a boiler 26 used to generate steam. The fuel gas may also be utilized as a heat source for the thermal cracking unit 2.

A suction fan 27 is installed to the gas supply system 22 as a means of drawing the fuel gas out of the gasification unit 3. The air pre-heater 24, which heats air by the temperature of the extracted fuel gas, and a filter 28, which removes foreign particles from the fuel gas, are respectively installed between the gas extraction port 15 and the suction fan 27, in a sequential manner from the gas extraction port 15. An air fan 29 is connected to the intake side of the air pre-heater 24. The 1st and 2nd oxidation gas supply parts 13 and 16 and an air intake port 30*a* of a burner 30 (which is installed within chamber 5 of the externally heated rotary kiln) are connected to the discharge side of the air pre-heater 24. The air drawn in by the air fan 29 is heated by the fuel gas passing through the air pre-heater 24, and supplied to the 1st and 2nd oxidation gas supply parts 13 and 16 and the burner 30. The discharge port of the suction fan 27 is connected both to the intake side of the heat exchanger 25 and a fuel intake port 30*b* of the burner 30.

The suction fan 27 sucks the fuel gas through the filter 28 for particle removal, and sends one portion of the fuel gas to the heat exchanger 25 and the remaining portion to the burner 30. The fuel gas supplied to the burner 30 is combusted with the air flowing in from the air pre-heater 24 with the resultant thermal energy being applied to heat the thermal medium in chamber 5. The thermal energy held in the fuel gas supplied to the heat exchanger 25 is used to generate hot water. The discharge side of the heat exchanger 25 is connected to the fuel gas intake part of the gas engine electrical generator 23 which combusts the fuel gas to generate electricity. The fuel gas is thus consumed by the gas engine electrical generator 23.

An exhaust gas system 31 emanating from the gas engine electrical generator 23 is connected to the thermal medium intake port of the chamber 5 of the externally heated rotary kiln, therefore allowing the exhaust gas from the electrical generator 23 to be supplied to the chamber 5 for use as a thermal medium utilized to apply thermal energy to the externally heated rotary kiln. This exhaust gas is heated by the burner 30. The thermal medium discharge port of the chamber 5 is connected to the boiler 26 through a discharge system 32, and the exhaust gas from the electrical generator 23, the gas being used as the thermal medium, is fed from the chamber 5 to the boiler 26 which generates steam. Exhaust gas processing unit 33, which is connected to the boiler 26, applies an exhaust gas treatment to the exhaust gas which was used to generate steam in the boiler 26. Moreover, the exhaust gas system 31 emanating from the gas engine electrical generator 23 and the discharge system 32 emanating from chamber 5 are connected via a controllable valve 34 which, thus disposed there between, may be closed as a means of connecting the exhaust gas system 31 to the chamber 5, or be opened to bypass the chamber 5 and direct the exhaust gas from the electrical generator 23 directly to the boiler 26.

The following will explain the operation of the biomass gasification apparatus 1 as described in the example. The biomass material exiting the material hopper 6 enters the reaction chamber 4 of the thermal cracking unit 2 via the loading port 4*a*. Due to the rotational movement and inclined disposition of the reaction chamber 4, the biomass material moves through the reaction chamber 4 while being indirectly heated by the thermal medium flowing through the chamber 5. The indirect application of thermal energy dries the biomass material and concurrently generates a combustible pyrolysis gas and a process remnant in the form of char. The pyrolysis gas contains a tar component. The pyrolysis gas and char flow from the extraction port 4*b* of the thermal cracking unit 2 and enter the gasification unit 3 at a temperature of approximately 600° C.

The char fed into the gasification unit 3 is temporarily held in the 1st accumulator 1 while concurrently falling downward into the 2nd accumulator 14 through the downflow duct 12. The tar-containing pyrolysis gas is drawn toward the gas extraction port 15 by the suction fan 27 of the gas supply system 22. In the tar component thermal cracking region 'A,' which extends from the 1st accumulator 11 to the gas extraction port 15, a portion of the char and pyrolysis gas is combusted by the injection of air supplied from the 1st oxidation gas supply part 13, and the temperature in the downflow duct 12 in the area around the 1st oxidation gas supply part 13 rises to approximately 1,100 to about 1,200° C. to thermally crack and gasify the tar component in the pyrolysis gas.

After the tar component contained in the pyrolysis gas has been thermally cracked, the pyrolysis gas is drawn toward the gas extraction port 15 by the suction fan 27 during which the char is subjected to a gas-solid reaction such as a carbon oxidation reaction ($C+CO_2 \rightarrow 2CO$) or hydro-gasification reaction ($C+H_2O \rightarrow CO+H_2$). Namely, the carbon dioxide and steam which has been generated by the previous combustive reaction are reduced by the carbon component in the char to create a combustible fuel gas such as carbon monoxide or hydrogen.

The char flowing down into the 2nd accumulator 14 is subjected to a combustion reaction generated by the air injected from the 2nd oxidation gas supply part 16, a reaction which generates a fuel gas having carbon dioxide and steam as its main components. Such a fuel gas moves upwardly through the 2nd accumulator 14 to the gas extraction port 15 during which the char is subjected to the previously, noted gas-solid reaction by the fuel gas to create carbon monoxide and hydrogen. In other words, the area between the 1st and 2nd oxidation gas supply parts 13 and 16 (tar component thermal cracking region 'A' and char gasification region 'B') where the combustion reaction is generated becomes reduction region 'C.'

Therefore, the pyrolysis gas which was generated in the thermal cracking unit 2, and whose tar component was removed while passing through 1st oxidation gas supply part 13, and the combustible fuel gas which was resulted from gasifying the char based on its gas-solid reaction around the 2nd oxidation gas supply part 16 are extracted through the gas extraction port 15 as fuel gas at a temperature of approximately 800° C. The ash generated by the gasification of the char in the 2nd accumulator 14 collects in the ash trap 18 from where it is discharged into the ash receiver 21.

To reiterate, the biomass gasification apparatus 1 described in the example is structured to include the thermal cracking unit 2 in the form of an externally heated rotary kiln which both dries and thermally cracks the biomass material, and the gasification unit 3 into which the pyrolysis gas at an approximate 600° C. temperature, already having been thermally cracked in the thermal cracking unit 2 and char are fed.

As is known in the art, an externally heated rotary kiln, structured as the thermal cracking unit 2 in the example, is equipped with the rotating reaction chamber 4 structured as a hollow cylinder within which the biomass material is mixed, transported, and indirectly heated while pyrolysis gas and chat are generated. Therefore, it can be assumed that generation of steam in the chamber 4 as well as injection of steam therein may have the effect of modifying the generated gas. This particular structure enables a gasification process which places no restrictions on the processing of biomass materials having a fibrous consistency, and does not require that the biomass materials fed into the reaction chamber 4 be of uniform size. In regard to the water content of the biomass material, this structure enables a gasification process not to require that restrictions be placed on the water content of the biomass materials to be processed, because, as is conventionally known, there are gasification processes in which steam injection may be utilized. Therefore, it is possible to have a gasification process with almost no limitations, that is, a process capable of gasifying a wider variety of biomass materials of various size and water content.

Moreover, the externally heated rotary kiln offers a high thermal transfer coefficient due to a contact thermal transfer mechanism, provides an efficient biomass-based gasification mechanism, simplifies controls of gasification temperature and the amount of generated pyrolysis gas and char through a control of the temperature within the chamber 5 and/or a control of the time during which the biomass material is held in the reaction chamber 4, and optimizes the integrated operation with the gasification unit 3.

The tar-containing pyrolysis gas and char generated in the thermal cracking unit 2 are fed to the gasification unit 3 where the injection of an oxidizing gas raises the temperature to a point where the tar component is removed and the char gasified. Therefore, although the gasification unit 3 may appear to resemble a downdraft furnace in structure and operation, it is different than a conventional downdraft furnace not only due to the division into tar component thermal cracking region 'A' and char gasification region 'B' only, but also because it is a simplified structure which enables efficient generation of fuel gas from biomass material. In other words, a highly efficient tar removal function is realized by the process wherein the pyrolysis gas flows into the gasification unit 3 where the tar component is thermally cracked in the high temperature region of a combustion reaction generated by the injection of air from the 1st oxidation gas supply part 13.

This structure thus enables a more compact system by eliminating the need for a gas reforming tower and accompanying gas cooling device whose installation is normally required downstream from the rotary kiln.

To explain further, the biomass gasification apparatus 1 described in the example performs an initial process in which the thermal cracking unit 2, in the form of an externally heated rotary kiln, is able to gasify a wide variety of biomass materials. For the subsequent process in the downstream of the thermal cracking unit 2, a simple downdraft type of gasification part 3 provides an effective tar removal and char gasification capability that does not require a biomass drying or thermal cracking function. The apparatus can therefore be made as a more simplified structure capable of gasifying a wide variety of biomass materials while providing an efficient tar removal capability.

The gasification unit 3 includes at least the tar component thermal cracking region 'A' and the char gasification region 'B,' and is therefore able to crack the tar in the former region and gasify the char in the latter. Moreover, the initial biomass gasification process is conducted by the thermal cracking unit 2 (in the form of an externally heated rotary kiln), and therefore the subsequent tar removal and char gasification process can be conducted by the gasification unit 3 which is structured as a simple shaft-type furnace made more compact in size because it need not execute a biomass drying and biomass thermal cracking function. Therefore, the gasification unit 3 is a simple and compact shaft-type furnace which has the effect of simplifying the structure of the biomass gasification apparatus 1.

Furthermore, the operation of the system has been highly rationalized by eliminating the need for an external heat source, using the fuel gas generated by the apparatus as the fuel combusted by the burner 30 to heat the thermal cracking unit 2, and applying exhaust heat from the apparatus as additional thermal energy used to heat the thermal cracking unit 2. Moreover, there is an advantage in being able to feed biomass materials, without concern as to the extent of their water content, into the externally heated rotary kiln (thermal cracking unit 2), whereby the steam generated therein can be used as a gasification agent in the gasification unit 3.

While the description of-the example specifies air as the oxidation gas supplied to the 1st and 2nd oxidation gas supply parts 13 and 16, other oxidation gasses, as well as gasses mixed with steam, may also be used. The gasification reaction may be controlled through the mixing in of steam, and the generated gas may be adjusted as preferred. Furthermore, a Stirling engine may be used in place of the gas engine electrical generator 23.

Preliminary calculations regarding the operation of the embodied biomass gasification apparatus 1 reveal that the pyrolysis gas generated in the thermal cracking unit 2 is at a temperature of 1,100° C. in the gasification unit 3. After being exposed to this temperature for three seconds, the fuel gas exiting the gas extraction port 15 has a tar density which has been reduced from 34 $g/m^3$ to 0.006 $g/m^3$ (calculated from standard conditions). In other words, the tar component is reduced by approximately 99%.

The invention claimed is:

1. A biomass gasification apparatus comprising:

an externally heated rotary kiln thermal cracking unit that indirectly heats and thermally cracks a biomass material to generate a tar-containing pyrolysis gas and char from the biomass material, and a gasification unit that receives the tar-containing pyrolysis gas and char from said thermal cracking unit, and thermally cracks the tar component in the pyrolysis gas and gasifies the char by an oxidation gas introduced therein, wherein said gasification unit comprises a tar component thermal cracking region in which the tar component is thermally cracked, a char gasification region in which the char is gasified and remaining ash discharged therefrom, and a reduction region in which a combustible fuel gas is created from combusted pyrolysis gas passed through said tar component thermal cracking region; and is a vertical shaft furnace having an insertion port, a first accumulator, a first oxidation gas supply part, a second accumulator, a gas extraction port, a second oxidation gas supply part, and an ash trap in sequence starting from a topmost part towards a bottom part, said insertion port connects to said thermal cracking unit and feeds the tar-containing pyrolysis gas and char to said gasification unit, said first accumulator is formed beneath said insertion port and temporarily stores flowing char downward from said insertion port, said first oxidation gas supply part is formed beneath said first accumulator to define inside a downflow duct for the flowing char and introduces an oxidation gas into said downflow duct, said second accumulator is formed below and connects to said downflow duct and provides a space for temporary storage of char flowing downward through said downward duct, said gas extraction port is formed at a top portion of said second accumulator directly below said first oxidation gas supply part and extracts gas generated in said gasification unit, said second oxidation gas supply part is structured at a lower portion of said second accumulator, guides the char downward and allows introduction of oxidation gas into said second accumulator, said ash trap is formed directly beneath said second accumulator, said tar component thermal cracking region is formed by a combustion reaction of the pyrolysis gas and oxidation gas supplied from said first oxidation gas supply part, said char gasification region is formed by a combustion reaction of the char and oxidation gas supplied from said second oxidation gas supply part, and said reduction region is formed between the tar component thermal cracking region and char gasification region to reduce the combusted pyrolysis gas by the flowing char.

* * * * *